US011608260B2

(12) United States Patent
Leeds et al.

(10) Patent No.: US 11,608,260 B2
(45) Date of Patent: Mar. 21, 2023

(54) WATER COOLER PAN OF BOTTLE FILLER FOUNTAIN

(71) Applicant: GLOBAL INDUSTRIAL DISTRIBUTION INC., Port Washington, NY (US)

(72) Inventors: Richard B. Leeds, Port Washington, NY (US); Bruce Zutler, Port Washington, NY (US); Phillip Lee, Port Washington, NY (US)

(73) Assignee: GLOBAL INDUSTRIAL DISTRIBUTION INC., Port Washington, NY (US)

( * ) Notice: Subject to any disclaimer, the term of this patent is extended or adjusted under 35 U.S.C. 154(b) by 0 days.

(21) Appl. No.: 17/204,505

(22) Filed: Mar. 17, 2021

(65) Prior Publication Data

US 2022/0297997 A1 Sep. 22, 2022

(51) Int. Cl.

| | |
|---|---|
| ***B67D 1/08*** | (2006.01) |
| ***B67D 1/00*** | (2006.01) |
| ***B67D 1/16*** | (2006.01) |

(52) U.S. Cl.

CPC ..... *B67D 1/0888* (2013.01); *B67D 1/0014* (2013.01); *B67D 1/0857* (2013.01); *B67D 1/16* (2013.01); *B67D 2210/0001* (2013.01)

(58) Field of Classification Search

CPC .. B67D 1/0888; B67D 1/0891; B67D 1/0857; B67D 1/0014; B67D 1/16; B67D 2210/0001

USPC ..... 222/108; 137/312

See application file for complete search history.

(56) References Cited

U.S. PATENT DOCUMENTS

| | | | | | |
|---|---|---|---|---|---|
| 4,917,155 | A * | 4/1990 | Koblasz | B67D 1/1238 | 367/908 |
| 5,063,977 | A * | 11/1991 | Belland | B67D 1/0894 | 141/86 |
| 5,542,572 | A * | 8/1996 | Davis | B67D 1/16 | 141/86 |
| 5,667,103 | A * | 9/1997 | Donselman | B67D 3/0022 | 62/394 |
| 5,827,428 | A * | 10/1998 | Chang | B67D 1/16 | 210/257.2 |
| 6,871,675 | B1 * | 3/2005 | Marszalec | B67D 1/0895 | 141/82 |
| 7,028,725 | B2 * | 4/2006 | Hooker | F25C 5/22 | 141/141 |
| 7,470,364 | B2 * | 12/2008 | Oranski | B67D 1/16 | 210/748.1 |
| 7,677,053 | B2 * | 3/2010 | Truitt | F25D 23/126 | 62/264 |
| 7,743,801 | B2 * | 6/2010 | Janardhanam | F25D 23/126 | 141/351 |

(Continued)

OTHER PUBLICATIONS

Elkay, Feb. 27, 2021, Waybackmachine http://elkay.com/us/en/drinking-water/collections/ez-wish-kit.html.*

*Primary Examiner* — Timothy L Maust

(74) *Attorney, Agent, or Firm* — Troutman Pepper Hamilton Sanders LLP

(57) ABSTRACT

A bottle filling station may include a liquid dispenser configured to dispense liquid. A pan may be configured to collect at least a portion of the dispensed liquid. A sensor may detect a presence of a liquid container. A controller may control the liquid dispenser to dispense liquid when the liquid container is approximately near the sensor.

12 Claims, 7 Drawing Sheets

(56) References Cited

U.S. PATENT DOCUMENTS

| | | | | |
|---|---|---|---|---|
| 7,784,205 | B1 * | 8/2010 | Baron | G09F 13/04 40/564 |
| 8,250,880 | B2 * | 8/2012 | Moon | F25D 23/126 62/448 |
| 8,353,321 | B2 * | 1/2013 | Agam | B67D 1/124 141/94 |
| 8,443,614 | B2 * | 5/2013 | Kim | F25D 29/00 62/3.64 |
| 8,485,392 | B1 * | 7/2013 | Tarter | B67D 7/84 222/23 |
| 9,016,509 | B2 * | 4/2015 | Santy | B67D 1/16 137/313 |
| 9,643,832 | B2 * | 5/2017 | Steward | B67D 1/0014 |
| 9,896,321 | B2 * | 2/2018 | Willis | B67D 1/0014 |
| 10,053,354 | B2 * | 8/2018 | Rosenlund | B67D 1/0081 |
| D876,890 | S * | 3/2020 | Young | B67D 1/16 D7/397 |
| 10,670,333 | B2 * | 6/2020 | Nanos | F25D 19/00 |
| 10,710,864 | B2 * | 7/2020 | Jangbarwala | B67D 1/0041 |
| 10,752,487 | B2 * | 8/2020 | Rosenlund | B67D 1/0882 |
| 10,926,993 | B2 * | 2/2021 | Lynch | B67D 1/1211 |
| 10,934,694 | B1 * | 3/2021 | Porter | E03C 1/326 |
| 11,021,360 | B2 * | 6/2021 | Melville, Jr. | B67D 1/0888 |
| 2003/0089423 | A1 * | 5/2003 | Barton | B67D 1/0888 141/198 |
| 2007/0272019 | A1 * | 11/2007 | Agam | G01S 15/88 73/628 |
| 2009/0242075 | A1 * | 10/2009 | Busick | C02F 1/325 141/85 |
| 2012/0138629 | A1 * | 6/2012 | Ashrafzadeh | B67D 1/0858 222/1 |
| 2016/0355388 | A1 * | 12/2016 | Willis | F25D 11/02 |
| 2018/0186621 | A1 * | 7/2018 | Jangbarwala | B67D 1/0041 |
| 2018/0215603 | A1 * | 8/2018 | Hecht | B67D 1/06 |
| 2019/0002264 | A1 * | 1/2019 | Madden | B67D 1/0036 |
| 2020/0122994 | A1 * | 4/2020 | Cimatti | B67D 1/0034 |
| 2020/0180932 | A1 * | 6/2020 | Gulati | B67D 1/0406 |
| 2020/0323397 | A1 * | 10/2020 | Simonovsky | G08B 7/06 |
| 2021/0164203 | A1 * | 6/2021 | Mavinahally | A47K 5/1217 |

* cited by examiner

WATER COOLER PAN OF BOTTLE FILLER FOUNTAIN

FIELD OF INVENTION

The present invention generally relates to a liquid dispenser station, and more particularly, to a bottle filing station for dispensing liquid based on detection of a presence of a bottle.

BACKGROUND

Existing wall mounted liquid dispensers have many known issues that need improvements. For example, existing wall mounted liquid dispensers typically have a drinking fountain that increases risks for virus transmission. To avoid such risks, there is a need for a simple and clean design of a liquid dispenser without a drinking fountain. Various embodiments of the disclosed technology address these needs.

SUMMARY

It is an object of the present invention to provide systems, devices, and methods to meet the above-stated needs. One aspect of the disclosed technology relates to a bottle filling station. The bottle filling station may include a liquid dispenser configured to dispense liquid.

A pan may be configured to collect at least a portion of the dispensed liquid. The pan may define a width of approximately 11 inches. A sensor may detect a presence of a liquid container. A controller may control the liquid dispenser to dispense liquid when the liquid container is approximately near the sensor.

In one embodiment, the pan may be positioned below the liquid dispenser.

In one embodiment, a cooling system may be located below the liquid dispenser.

In one embodiment, a cooling system may be disposed within the liquid dispenser.

In one embodiment, the pan may include a stainless-steel basin.

In one embodiment, the pan may include a plurality of protrusions to support the liquid container when at rest, and direct spilled water into the basin.

In one embodiment, the pan may not include a bubbler.

In one embodiment, the pan may not include any secondary attachment.

In one embodiment, the controller may open and close a bottle filling water valve based on the detection by the sensor.

In one embodiment, the pan may have an outer surface that defines a rectangular profile.

In one embodiment, the pan may have an outer surface that defines a semi-spherical profile.

In one embodiment, the cooling system may have an access door to access content of an interior volume of the cooling system.

In one embodiment, the liquid dispenser may have an access door to access content of an interior volume of the liquid dispenser.

In one embodiment, the pan may define a flat sloping pan shape.

Another aspect of the disclosed technology relates to a bottle filling station. The bottle filling station may include a liquid dispenser configured to dispense liquid. A pan may be configured to collect at least a portion of the dispensed liquid. The pan may define a width of approximately 11 inches. An activation sensor may be configured to control the liquid dispenser to dispense liquid when the activation sensor is triggered.

In one embodiment, the activation sensor may include a button disposed on the bottle filling station.

In one embodiment, the activation sensor may be disposed anywhere on the bottle filling station.

A further aspect of the disclosed technology relates to a bottle filling station. The bottle filling station may include a liquid dispenser configured to dispense liquid. A pan may be configured to collect at least a portion of the dispensed liquid. An access door may access content of an interior volume of the liquid dispenser.

In one embodiment, the access door may be disposed on a side of the liquid dispenser.

In one embodiment, the access door may be disposed on a front of the liquid dispenser.

Various aspects of the described example embodiments may be combined with aspects of certain other example embodiments to realize yet further embodiments. It is to be understood that one or more features of any one example may be combined with one or more features of the other example. In addition, any single feature or combination of features in any example or examples may constitute patentable subject matter. Other features of the technology will be apparent from consideration of the information contained in the following detailed description.

BRIEF DESCRIPTION OF THE DRAWINGS

The above and further aspects of this invention are further discussed with reference to the following description in conjunction with the accompanying drawings, in which like numerals indicate like structural elements and features in various figures. The drawings are not necessarily to scale, emphasis instead being placed upon illustrating principles of the invention. The figures depict one or more implementations of the inventive devices, by way of example only, not by way of limitation. Like reference numerals in the various figures are utilized to designate like components.

DETAILED DESCRIPTION

Figure 1:
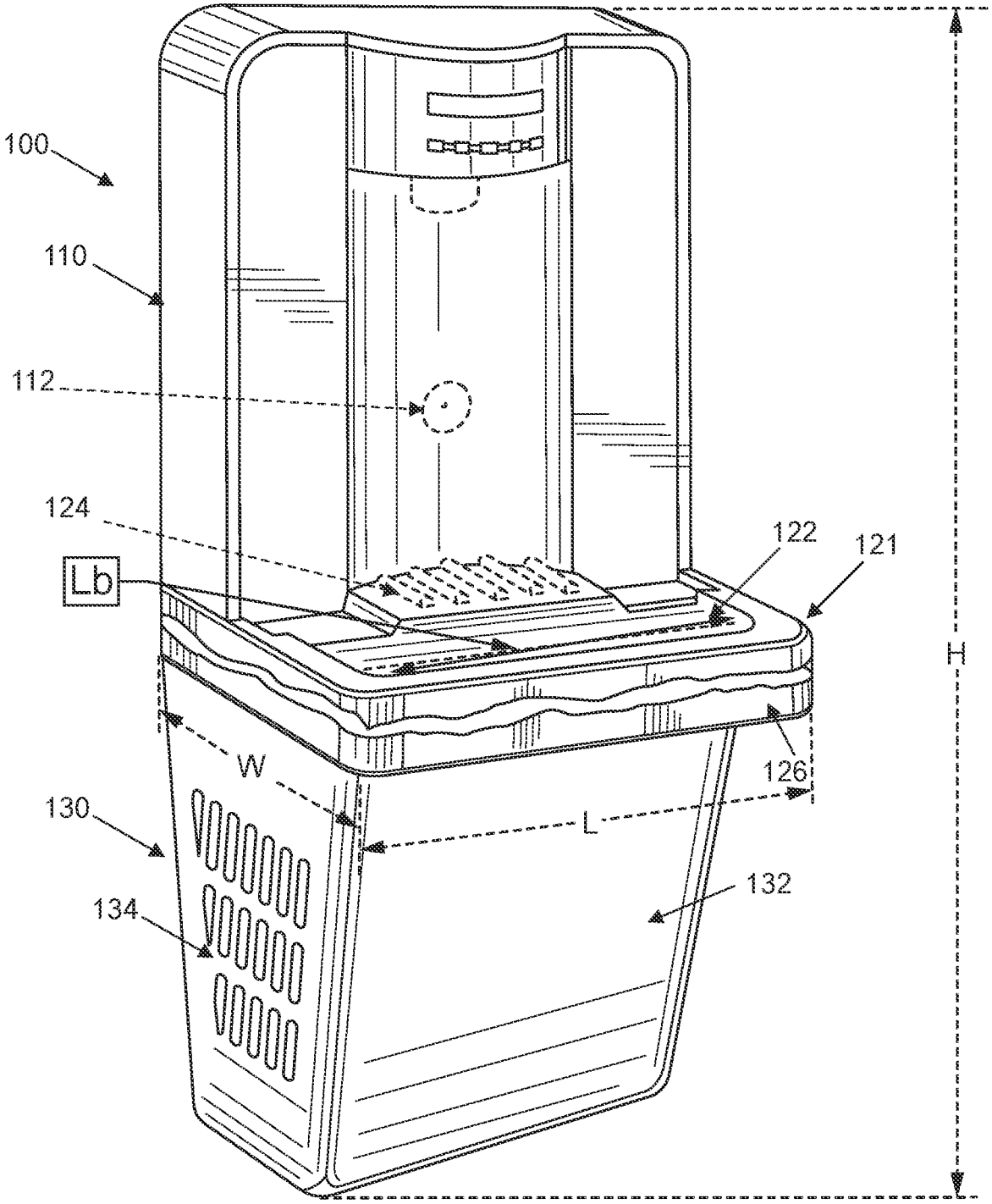
FIG. 1 is an illustration of an example bottle filling station according to a first embodiment of the present invention.

A first embodiment of a bottle filling station or liquid dispenser station 100 is illustrated in FIG. 1. The bottle filling station 100 may include a liquid dispenser or bottle filler 110 configured to dispense liquid. The bottle filling station 100 may not have a drinking fountain or "bubbler".

The bottle filling station 100 may use a common drain location and alignment of equipment used for conventional bottle filler or water cooler form factors. The bottle filling station 100 may include a drain that flows to the common prior drain location.

A pan 121 may be configured to collect at least a portion of the dispensed liquid. The pan 121 may be positioned below the liquid dispenser 110. The pan 121 may define an outer surface 126 exhibiting a rectangular profile. The pan 121 may not include a bubbler. The pan 121 may define a width "W" of about 11 inches. For example, the width of the pan 121 may be about 10.84598425 inches. The pan 121 may define a length "L" of about 18 inches. For example, the length of the pan 121 may be about 17.9134 inches. The bottle filling station 100 as a whole may have a height "H" of approximately 38 inches. For example, the height of the bottle filling station may be about 37.905512 inches. The pan 121 may not include any secondary attachment.

The pan 121 may include a stainless-steel basin 122. A plurality of protrusions 124 may be disposed on top of the pan 121 to support a liquid container when at rest, and to act as veins to direct spilled water into the basin 122. All plumbing and chilling apparatus may be provided below the basin 122.

The basin 122 can have a basin length Lb of approximately 14.6 inches to approximately 16.5 inches and that length can vary top to bottom as well. A basin width Wb can vary between approximately 3.97 inches to approximately 5 inches, again top to bottom. A basin depth Db of approximately 1.80 inches to approximately 1.89 inches with an approximately 1 degree down slope to the drain.

A cooling system 130 may be located below the liquid dispenser 110. The pan may be optimized or conformed to match the cooling system 130. The cooling system 130 may include a stainless steel lower container 132. The lower container 132 may enclose an interior volume, and an access door 134, disposed in the lower container 132. The access door may have an open position that allows access to the interior volume. A DC power supply powering the bottle filling station 100 and the cooling system 130 may be disposed in the interior volume. Further, a filter, where the liquid to be dispensed passes therethrough, may be disposed in the interior volume. The access door may allow access to replace the filter, change to programing through a controller and can provide internal access to electrical and plumbing elements.

While the lower container 132 can be stainless steel, other examples can from it from high impact polymers. These polymers can withstand impacts without denting and have a surface that is more resistant to paint. Both features help make the dispenser 100 more vandal resistant.

Figure 2:
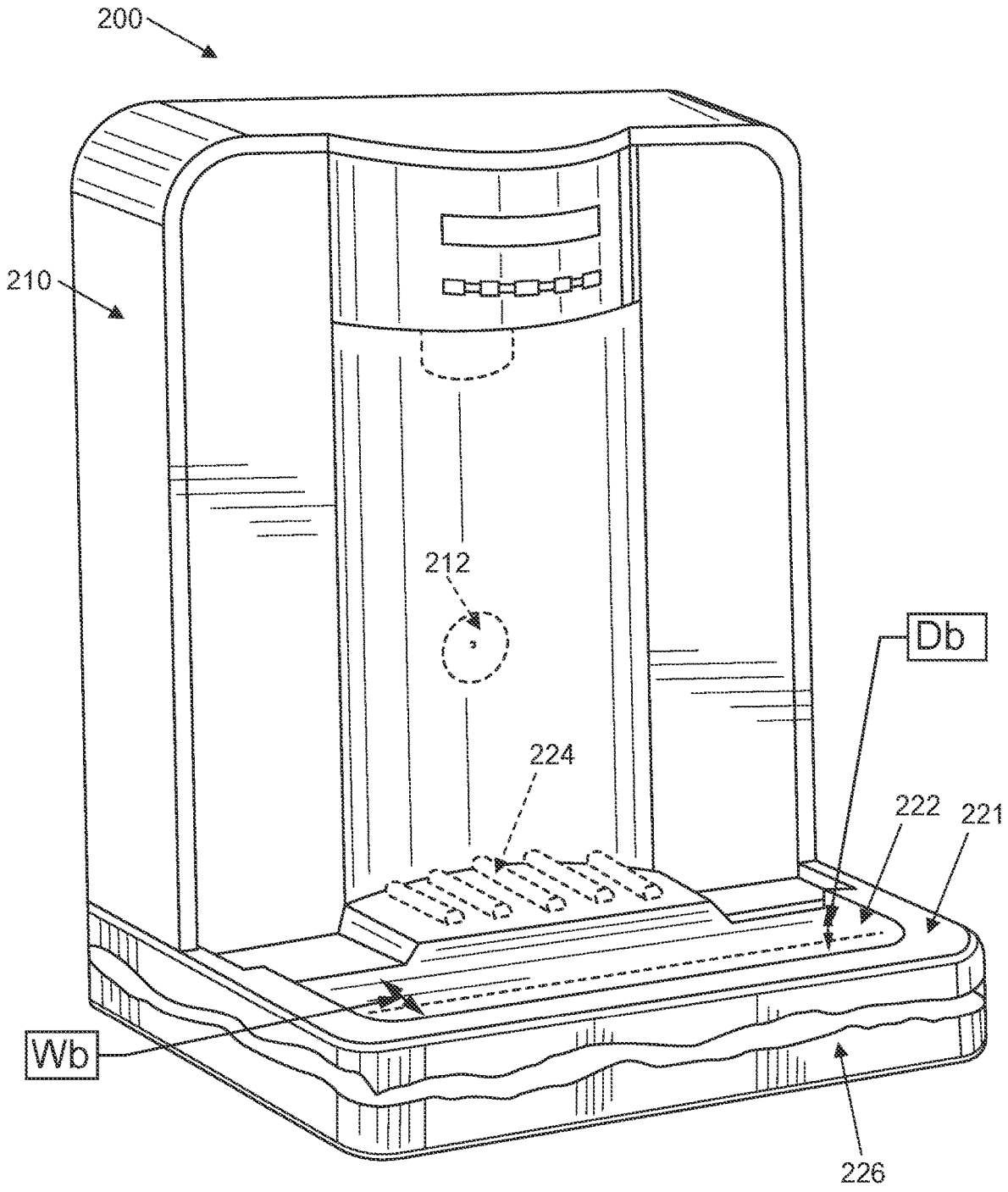
FIG. 2 is an illustration of an example bottle filling station according to a second embodiment of the present invention.

A sensor 112 may detect a presence of the liquid container, such as a bottle. The sensor 112 may include an infrared (IR) sensor for detecting the presence of the liquid container. The IR sensor may include at least one of an IR photodiode, an IR light emitting diode (LED), and associated electrical circuitry for receiving IR signals from the IR photodiode and transmitting light from the IR LED. Control of the IR sensor may be software based. The IR sensor may detect the presence of the liquid container. FIG. 2 illustrates a second embodiment of a bottle filling station or liquid dispenser station 200. The bottle filling station 200 may include a liquid dispenser or bottle filler 210 configured to dispense liquid. The bottle filling station 100 may not have a drinking fountain.

The bottle filler 210 may include a cooling system therein. An interior volume of the bottle filler 210 may include one or more of the following: a DC power supply powering the bottle filling station 200, a filter where the liquid to be dispensed passes therethrough, a controller and electrical and plumbing elements.

Similar to the bottle filing station 100 of the first embodiment, the bottle filling station 200 of the second embodiment may include a pan 221 configured to collect at least a portion of the dispensed liquid. The pan 221 may define an outer surface 226 exhibiting a rectangular profile. The pan 221 may not include a bubbler. The pan 221 may include a stainless-steel basin 222. A plurality of protrusions 224 may be disposed on top of the pan 221 to support a liquid container when at rest, and to act as veins to direct spilled water into the basin 222. A sensor 212 may detect a presence of the liquid container, such as a bottle.

Figure 3:
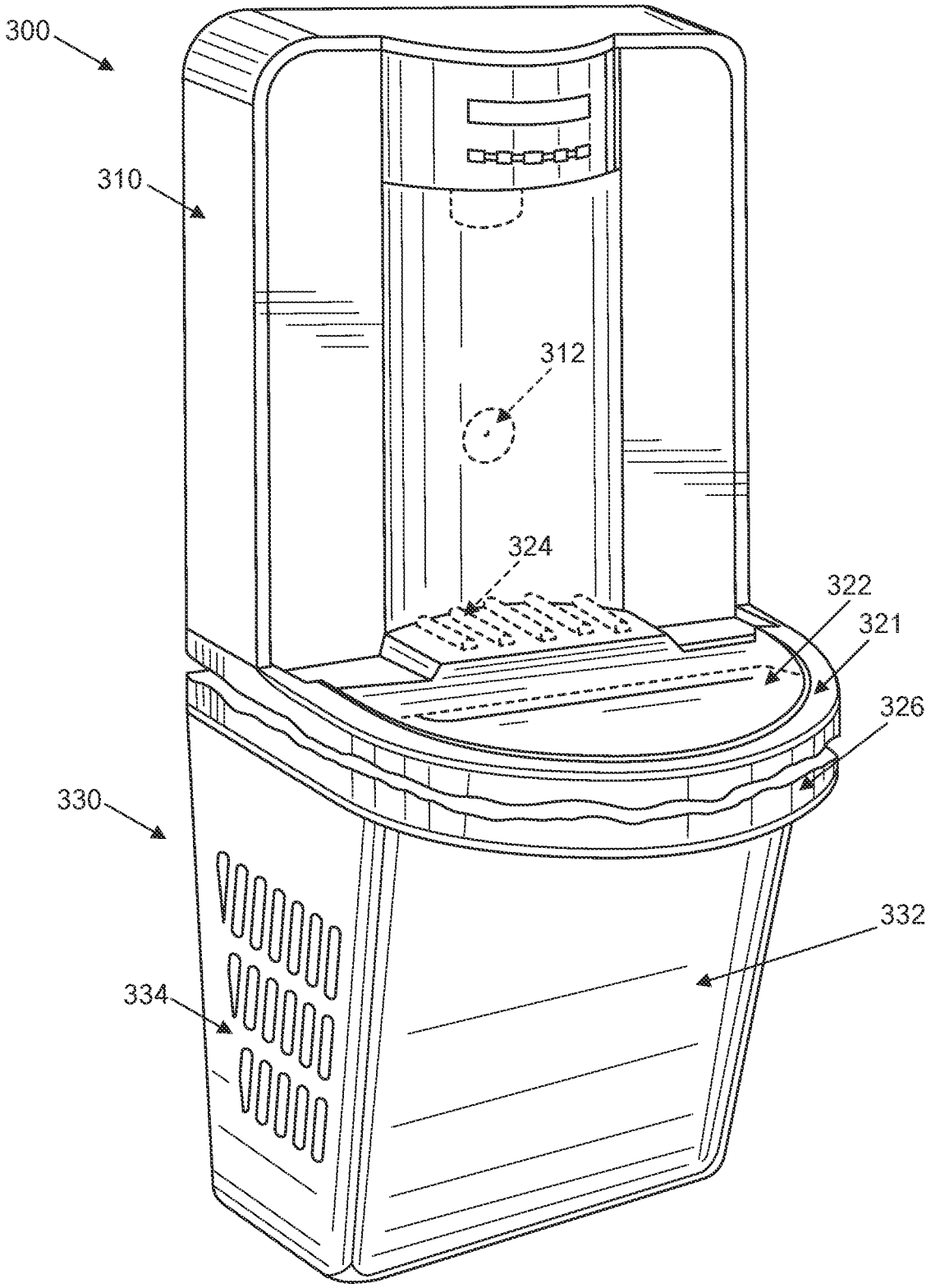
FIG. 3 is an illustration of an example bottle filling station according to a third embodiment of the present invention.

FIG. 3 illustrates a third embodiment of a bottle filling station or liquid dispenser station 300. The bottle filling station 300 may include a liquid dispenser or bottle filler 310 configured to dispense liquid. The bottle filling station 300 may not have a drinking fountain.

A pan 321 may be configured to collect at least a portion of the dispensed liquid. The pan 321 may define an outer surface 326 exhibiting a semi-spherical profile. The pan 321 may not include a bubbler. The pan 321 may have dimensions similar to that of the pan 121. For example, the pan 321 may define a width of about 11 inches. For example, the width of the pan 321 may be about 10.84598425 inches. The pan 321 may define a length of about 18 inches. For example, the length of the pan 321 may be about 17.9134 inches.

The pan 321 may include a stainless-steel basin 322. A plurality of protrusions 324 may be disposed on top of the pan 321 to support a liquid container when at rest, and to act as veins to direct spilled water into the basin 322. A sensor 312 may detect a presence of the liquid container, such as a bottle.

A cooling system 330 may be located below the liquid dispenser 310. The cooling system 330 may include a stain steel, lower container 332. The lower container 332 may enclose an interior volume, and an access door 334, disposed in the lower container 332. The access door 334 may allow access to an interior volume of the lower container 332 which may include one or more of the following: a DC power supply powering the bottle filling station 300, a filter where the liquid to be dispensed passes therethrough, a controller and electrical and plumbing elements.

Figure 4:
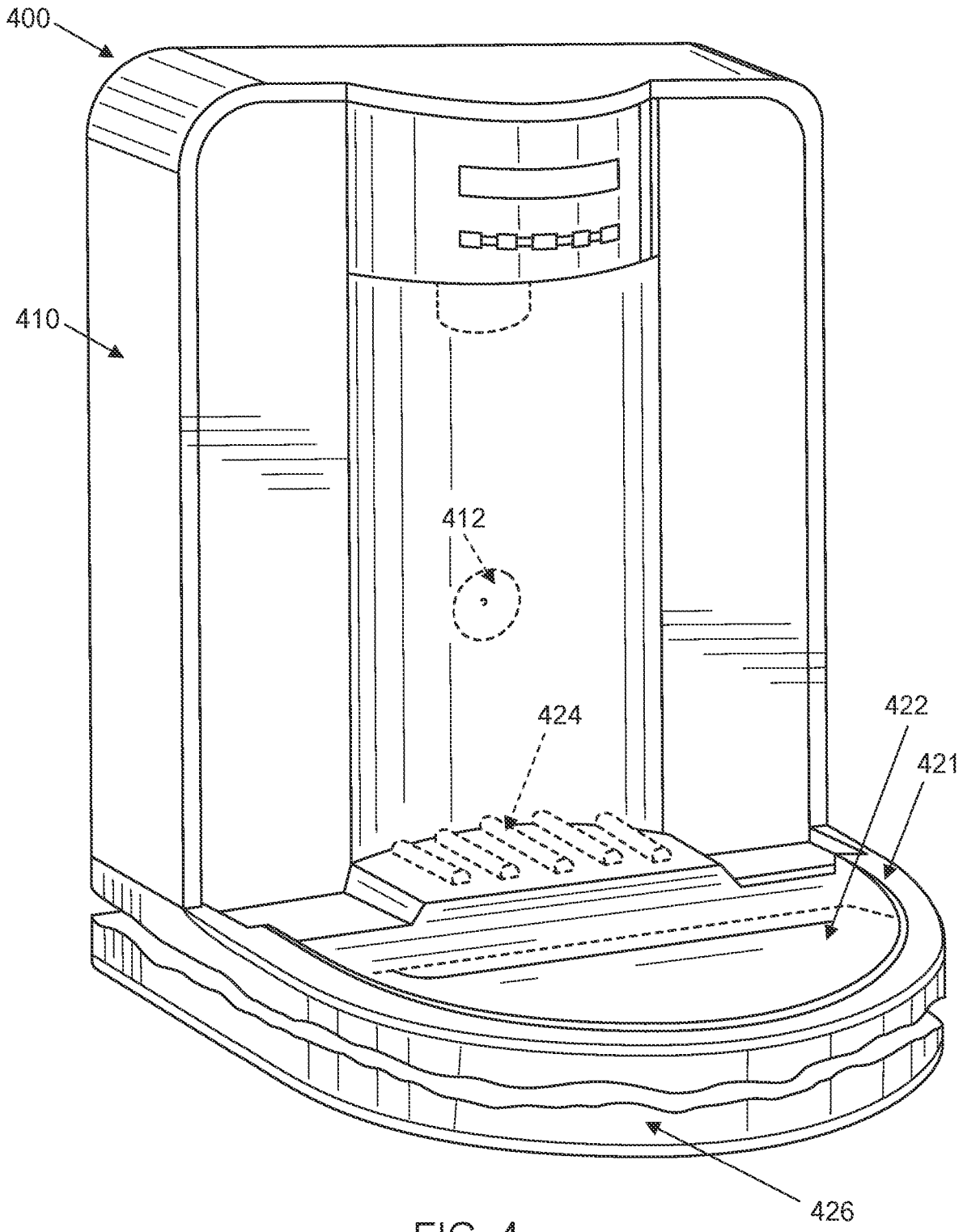
FIG. 4 is an illustration of an example bottle filling station according to a fourth embodiment of the present invention.

FIG. 4 illustrates a fourth embodiment of a bottle filling station or liquid dispenser station 400. The bottle filling station 400 may include a liquid dispenser or bottle filler 410 configured to dispense liquid. The bottle filling station 400 may not have a drinking fountain.

The bottle filler 410 may include a cooling system therein. An interior volume of the bottle filler 410 may include one or more of the following: a DC power supply powering the bottle filling station 400, a filter where the liquid to be dispensed passes therethrough, a controller and electrical and plumbing elements.

A pan 421 may be configured to collect at least a portion of the dispensed liquid. The pan 421 may define an outer surface 426 exhibiting a semi-spherical profile. The pan 421 may not include a bubbler. The pan 421 may include a stainless-steel basin 422. A plurality of protrusions 424 may be disposed on top of the pan 421 to support a liquid container when at rest, and to act as veins to direct spilled water into the basin 422. A sensor 412 may detect a presence of the liquid container, such as a bottle.

Figure 5:
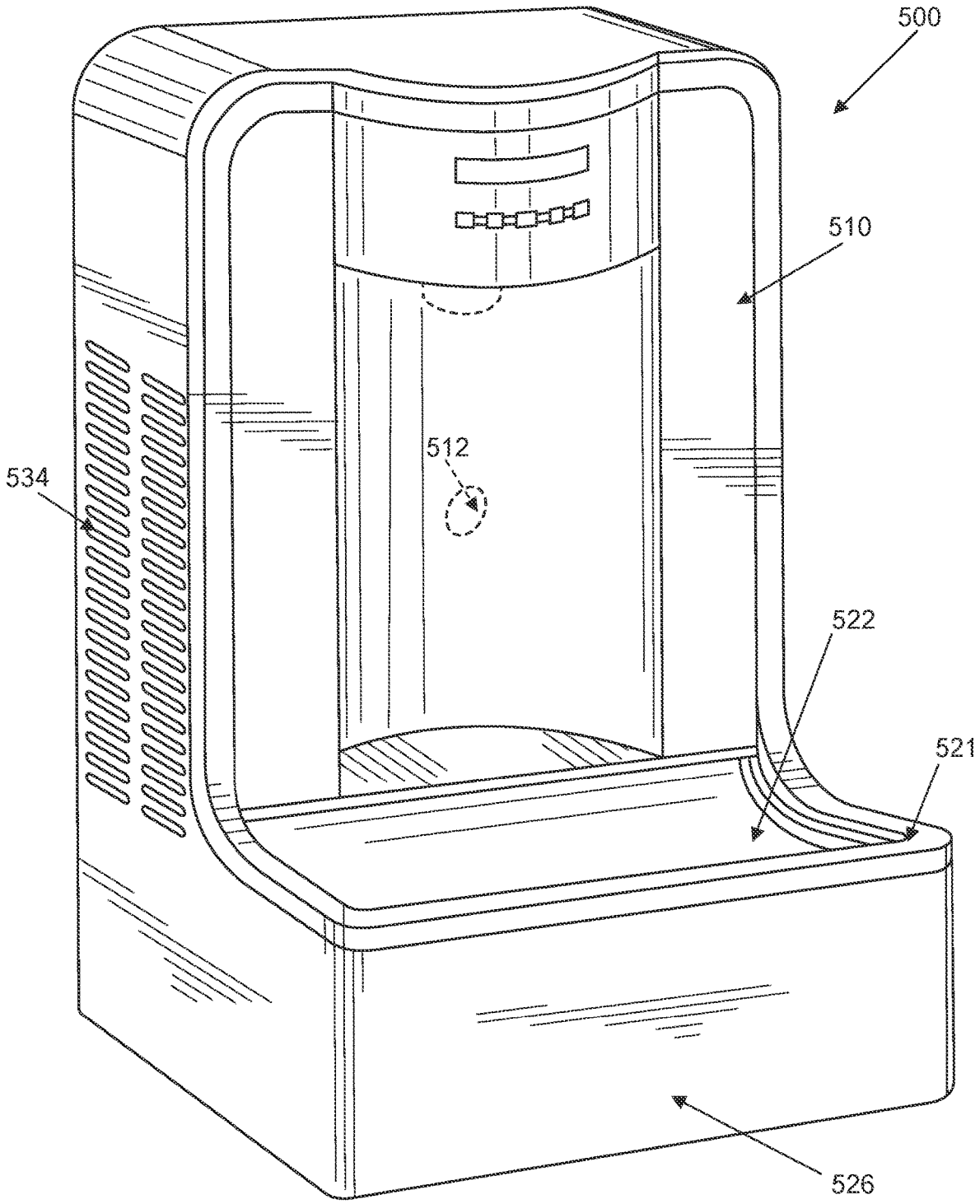
FIG. 5 is an illustration of an example bottle filling station according to a fifth embodiment of the present invention.

FIG. 5 illustrates a fourth embodiment of a bottle filling station or liquid dispenser station 500. The bottle filling station 500 may include a liquid dispenser or bottle filler 510 configured to dispense liquid. The bottle filling station 500 may not have a drinking fountain.

The bottle filler 510 may include a cooling system therein, and an access door 534 to access interior volume of the bottle filter 510. The access door 534 may be disposed on a side of the bottle filler 510. Alternatively, the access door 534 may be disposed on a front of the bottle filler 510.

The interior volume of the bottle filler 510 may include one or more of the following: a DC power supply powering the bottle filling station 500, a filter where the liquid to be dispensed passes therethrough, a controller and electrical and plumbing elements.

A pan 521 may be configured to collect at least a portion of the dispensed liquid. The pan 521 may define an outer surface 526 exhibiting a rectangular profile. The pan 521 may define a flat sloping pan shape. The pan 521 may not include a bubbler. The pan 521 may include a stainless-steel basin 522. A sensor 512 may detect a presence of the liquid container, such as a bottle.

Figure 6:
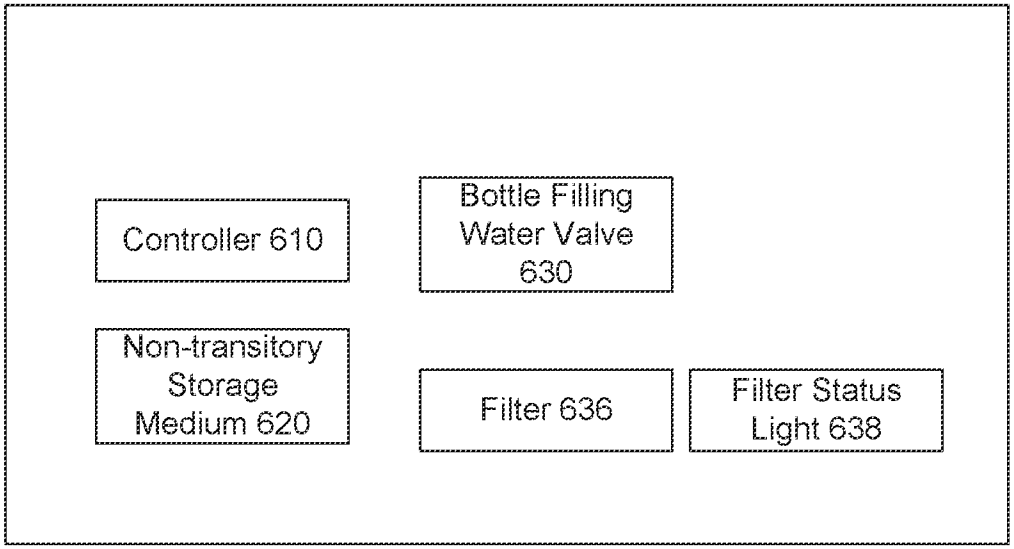
FIG. 6 is a block diagram of an example bottle filling station according to aspects of the present invention.

FIG. 6 illustrates example components that may be contained within one or more embodiments of the bottle filing station of the present invention. A controller 610 may control the bottle filler to dispense liquid when the liquid container is approximately near the IR sensor. The controller 610 may open and close a bottle filling water valve 630 based on the detection by the sensor. A non-transitory storage medium 620 may be configured to store a sensitivity level. The sensitivity level may be used by the sensor for detecting the presence of the liquid container.

A filter 636 may allow the liquid to be dispensed to pass therethrough. The filter 636 may be removable. The filter 636 may be disposable and replaceable. A filter status light 638 may indicate a status of the filter 636.

Figure 7:
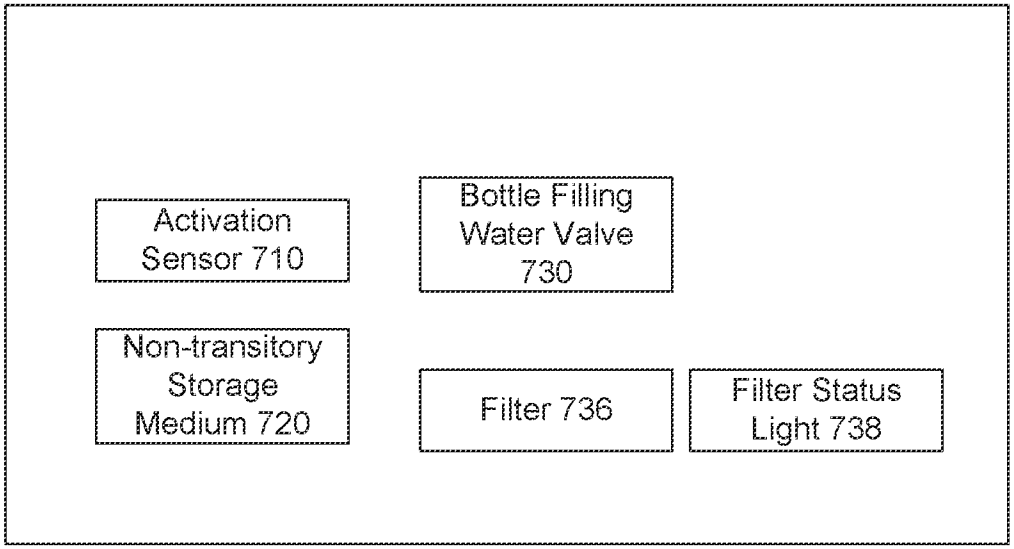
FIG. 7 is a block diagram of another example bottle filling station according to aspects of the present invention.

FIG. 7 illustrates another example components that may be contained within one or more embodiments of the bottle filing station of the present invention. An activation sensor 710 may control the bottle filler to dispense liquid when the activation sensor is triggered. The activation sensor 710 may open and close a bottle filling water valve 730 once the activation sensor is triggered. The activation sensor 710 may include a button. A user may press the button to activate dispensing liquid. The activation sensor 710 may be located anywhere on the bottle filling station. The non-transitory storage medium 720, the filter 736, and the filter status light 738 may function similarly to those illustrated in FIG. 6.

The descriptions contained herein are examples of embodiments of the invention and are not intended in any way to limit the scope of the invention. As described herein, the invention contemplates many variations and modifications of the insertion apparatus. These modifications would be apparent to those having ordinary skill in the art to which this invention relates and are intended to be within the scope of the claims which follow.

What is claimed is:

1. A bottle filling station comprising:
a liquid dispenser configured to dispense liquid;
a pan comprising:
a basin within the pan and configured to collect the dispensed liquid, and
a plurality of protrusions, separate from and behind the basin, to support a liquid container when at rest, and direct spilled water forward and into the basin,
wherein the pan defines a width of approximately 11 inches;
a sensor detecting a presence of a liquid container; and
a controller controlling the liquid dispenser to dispense liquid when the liquid container is approximately near the sensor,
wherein the bottle filling station is a standalone bottle filling station that does not include a drinking fountain.

2. The bottle filling station of claim 1, further comprising a cooling system located below the liquid dispenser.

3. The bottle filling station of claim 1, further comprising a cooling system within the liquid dispenser.

4. The bottle filling station of claim 1, wherein the controller opens and closes a bottle filling water valve based on the detection by the sensor.

5. The bottle filling station of claim 1, wherein the pan has an outer surface that defines one of a rectangular profile and a semi-spherical profile.

6. The bottle filling station of claim 1, further comprising:
a storage medium configured to store a sensitivity level, wherein the sensor detects the presence of the liquid container by using the sensitivity level.

7. The bottle filling station of claim 1, wherein the liquid dispenser comprises a convex cavity, and the controller is disposed within the convex cavity.

8. The bottle filling station of claim 1, wherein the interior volume encloses one or more of a power supply, a filter, the controller, an electrical element, a plumbing element, or combinations thereof.

9. The bottle filling station of claim 1, wherein the pan further comprises a raised platform, and the plurality of protrusions are disposed on top of the raised platform.

10. The bottle filling station of claim 1, wherein the plurality of protrusions are configured parallel to the width of the pan.

11. The bottle filling station of claim 1, further comprising:
a lower container comprising:
a plurality of sides; and
an access door disposed on only a first side of the plurality of sides and configured to access an interior volume of the liquid dispenser.

12. A bottle filling station comprising:
a liquid dispenser consisting of a bottle filler and configured to dispense liquid;
a pan comprising:
a plurality of protrusions disposed under the liquid dispenser to support a liquid container when at rest, and direct spilled water forward and into a basin within the pan,
wherein the basin is in front of the plurality of protrusions and configured to collect the dispensed liquid; and
an activation sensor configured to control the liquid dispenser to dispense liquid when the activation sensor is triggered,
wherein the bottle filling station is a standalone bottle filling station that does not include a drinking fountain.

* * * * *